US007896304B1

(12) United States Patent
Eichinger et al.

(10) Patent No.: US 7,896,304 B1
(45) Date of Patent: Mar. 1, 2011

(54) MARINE PROPULSION SUPPORT MOUNT SYSTEM

(75) Inventors: Charles E. Eichinger, Oshkosh, WI (US); Daniel P. Klawitter, Beaver Dam, WI (US)

(73) Assignee: Brunswick Corporation, Lake Forest, IL (US)

( * ) Notice: Subject to any disclaimer, the term of this patent is extended or adjusted under 35 U.S.C. 154(b) by 448 days.

(21) Appl. No.: 12/193,807

(22) Filed: Aug. 19, 2008

(51) Int. Cl.
*F16M 11/32* (2006.01)

(52) U.S. Cl. ..... 248/440; 440/52

(58) Field of Classification Search ..... 248/640, 248/641, 642, 643, 674, 638; 440/52
See application file for complete search history.

(56) References Cited

U.S. PATENT DOCUMENTS

| | | | | |
|---|---|---|---|---|
| 3,599,594 | A | 8/1971 | Taipale | |
| 3,934,537 | A | 1/1976 | Hall | |
| 3,961,595 | A | 6/1976 | Meyer | |
| 4,979,918 | A | 12/1990 | Breckenfeld et al. | |
| 5,192,235 | A | 3/1993 | Dunham et al. | |
| 5,443,406 | A | 8/1995 | Mondek et al. | |
| 5,881,991 | A | 3/1999 | Bonin | |
| 6,132,183 | A * | 10/2000 | Li et al. | 417/363 |
| 6,146,220 | A | 11/2000 | Alby et al. | |
| 6,419,534 | B1 | 7/2002 | Helsel et al. | |
| 6,645,019 | B1 | 11/2003 | Shiomi et al. | |
| 6,656,003 | B1 | 12/2003 | Kitsu et al. | |
| 6,912,865 | B2 * | 7/2005 | Seo et al. | 62/295 |
| 7,198,530 | B1 | 4/2007 | Rothe et al. | |
| 2006/0125330 | A1 * | 6/2006 | Winkler et al. | 310/51 |

OTHER PUBLICATIONS

Harris, Cyril M. & Crede, Charles E., "Shock and Vibration Handbook", pp. 3-24-3-29, vol. 1—Basic Theory and Measurements, McGraw-Hill Book Company.

* cited by examiner

*Primary Examiner* — Ramon O Ramirez
(74) *Attorney, Agent, or Firm* — William D. Lanyi

(57) ABSTRACT

A support system for an outboard motor uses mounts which are configured and positioned to result in an elastic center point being located closely to a roll axis of the outboard motor which is generally vertical and extends through a center of gravity of the outboard motor. The mounts are positioned so that lines which are perpendicular to their respective center lines intersect at an angle which can be generally equal to 90 degrees. The mounts are positioned in non-interfering relationship with the exhaust components of the outboard motor and its oil sump.

20 Claims, 7 Drawing Sheets

MARINE PROPULSION SUPPORT MOUNT SYSTEM

BACKGROUND OF THE INVENTION

1. Field of the Invention

The present invention is generally related to a support system for a marine propulsion device and, more particularly, to an outboard motor with support mounts that are positioned to define an effective elastic center which is generally coincident with a torque roll axis near the center of gravity of the outboard motor while positioning the mounts away from both the exhaust system and the oil sump of the outboard motor.

2. Description of the Related Art

Those skilled in the art of outboard motor design are aware of many different types of support systems that use mounts of different shapes and configurations. Typically, the mounts are constructed of a combination of metallic structures and elastomeric elements. Some mounts are generally tubular with a cylindrical elastomeric member being disposed between a cylindrical rod and a surrounding cylindrical tube. Other mounts utilize various metallic and elastomeric portions that are shaped to suit the specific characteristics necessary for particular applications.

U.S. Pat. No. 3,599,594, which issued to Taipale on Aug. 17, 1971, describes a sound and vibration isolating mount for an outboard motor. The arrangement has a marine propulsion unit mounted rearwardly of the steering axis of an outboard motor. The mounting arrangement includes a pair of mounts secured to the propulsion unit in a vertically spaced relation approximately in alignment with the neutral or roll axis of the propulsion unit and rearwardly of or behind the driveshaft. Each mount includes a cross bar which is supported by a resilient bushing within a casing and which has ends extending outwardly from the casing transversely to the direction of motion of the propulsion unit.

U.S. Pat. No. 3,934,537, which issued to Hall on Jan. 27, 1976, describes a vibration isolating mount for an outboard motor. A propulsion unit is mounted rearwardly of the steering axis of an outboard motor. It includes a powerhead, a driveshaft housing having a driveshaft, and a lower unit carrying a propeller. The mounting arrangement includes an upper mount and a pair of lower mounts secured to the propulsion unit in vertically spaced relation and rearwardly of or behind the driveshaft. The top mount includes a cross bar which has a wedge shaped cross-section with the upper and lower surfaces thereof converging in the direction of propeller thrusts, which is supported by a resilient bushing within a casing, and which has outer ends extending from the casing transversely to the direction of propeller thrusts for connection to a swivel bracket.

U.S. Pat. No. 3,961,595, which issued to Meyer on Jun. 8, 1976, discloses a steering apparatus for small outboard motors. A steering tiller handle assembly is attached to the driveshaft housing and pivotally mounted within a swivel mounting bracket assembly. The swivel bracket assembly includes a split tubular element within which a split tubular section of the steering arm assembly is notably mounted and located encircling a tubular portion of the driveshaft housing. Upper and lower annular rubber mounts are located between the upper and lower end of the steering tubular section and the driveshaft housing. Each mount is formed with a first pair of axial slots formed in diametrically opposing sides of the mount and projecting inwardly from one end.

U.S. Pat. No. 4,979,918, which issued to Breckenfeld et al. on Dec. 25, 1990, describes an outboard motor vibration isolation system. It comprises a propulsion unit including a cavity defined in part by a wall, an opening communicating with the cavity, a rubber mount insertable into the cavity through the opening, and an expandable wedge insertable through the opening and into the cavity, securable to the propulsion unit, and engageable with the rubber mount for fixedly securing the rubber mount to the propulsion unit and between the insertable expandable wedge and the wall of the cavity.

U.S. Pat. No. 5,192,235, which issued to Dunham et al. on Mar. 9, 1993, describes an outboard motor vibration isolation system including an improved rubber mount. It comprises a propulsion unit including a wall defining a cavity, and a rubber mount which is located in the cavity and which includes an annular outer shell having an outer surface engaging the wall and an inner surface defining an axially extending bore having a minimum diameter, an inner core extending through the bore, being adapted to be connected to a kingpin, and including an end core portion having a diameter less than the minimum diameter, and an opposite end core portion having a diameter greater than the minimum diameter, and a resilient member extending between the outer shell surface and the inner core.

U.S. Pat. No. 5,443,406, which issued to Mondek et al. on Aug. 22, 1995, describes a vibration isolating mounting for an outboard motor. It comprises a propulsion unit assembly having forwardly located laterally spaced portions respectively including laterally aligned outwardly opening sockets and laterally aligned horizontally extending apertures communicating with the sockets. A kingpin assembly includes a portion located between the laterally extending portions and includes a laterally extending bore aligned with the apertures. It also includes rubber mount assemblies respectively engaged in the sockets and having respective bores in alignment with the bore in the kingpin assembly.

U.S. Pat. No. 5,881,991, which issued to Bonin on Mar. 16, 1999, describes a mount assembly for an outboard motor frame. It includes two mount assembly fittings which each have a bolt on a fitting cover and a channeled fitting plate. The mount assembly includes a threaded mounting bolt having a bolt shaft having a threaded end, an interior tubular bushing having a shaft passageway sized to receive a portion of the bolt shaft, a helically coiled compression spring of a length longer than the interior tubular bushing and sized to pass over the interior tubular bushing, and an outer bushing having a bushing passageway having a bushing passageway diameter sufficient to allow the compression spring to be positioned into the bushing passageway.

U.S. Pat. No. 6,146,220, which issued to Alby et al. on Nov. 14, 2000, discloses a pedestal mount for an outboard motor. An outboard motor is mounted to a transom of a boat with a pedestal that is attached either directly to the transom or to an intermediate plate that is, in turn, attached to the transom. A motor support platform is attached to the outboard motor, and a steering mechanism is attached to both pedestal and the motor support platform. The tilting mechanism is attached to the motor support platform and to the outboard motor.

U.S. Pat. No. 6,419,534, which issued to Helsel et al. on Jul. 16, 2002, discloses a structural support system for an outboard motor. A support system is provided for an outboard motor which uses four connectors attached to a support structure and to an engine system for isolating vibration from being transmitted to the marine vessel to which the outboard is attached. Each connector comprises an elastomeric portion for the purpose of isolating the vibration. Furthermore, the four connectors are disposed in a common plane which is generally perpendicular to a central axis of a driveshaft of the outboard motor. Although precise perpendicularity with the driveshaft axis is not required, it has been determined that if the plane extending through the connectors is within 45 degrees of perpendicularity with the driveshaft axis, improved vibration isolation can be achieved.

U.S. Pat. No. 6,645,019, which issued to Shiomi et al. on Nov. 11, 2003, describes an outboard engine system. An inertia force is generated longitudinally by a piston and is countervailed by an inertia force generated by a crankshaft. Inertial forces subsidiarily laterally generated vibrate a body of the outboard engine system laterally about a phantom center point of vibration. An elastomeric member resiliently supporting the system body on a hull has a rigidity in a tangent direction about the phantom center point of vibration which is set to be lower than a rigidity in a radial direction about the phantom center point of vibration.

U.S. Pat. No. 6,656,003, which issued to Kitsu et al. on Dec. 2, 2003, describes an anti-vibration supporting structure for an outboard engine system. A center frame is fixed to a lower end of a swivel shaft of an outboard engine system by a bolt and includes a swivel shaft extension extending downwards from the lower end of the swivel shaft and a core metal which extends laterally from a lower end of the swivel shaft extension and has a lower mount rubber integrally baked thereto.

U.S. Pat. No. 7,198,530, which issued to Rothe et al. on Apr. 3, 2007, discloses a resilient mount system for an outboard motor. The support structure for an outboard motor provides a connection bar between an engine support structure and a steering structure. A tubular outer member is spaced apart from the attachment bar and connected to the attachment bar with an elastomeric member. Vibration isolation and consistency of deformation is achieved through the interaction of the individual elements of the structure.

The patents described above are hereby expressly incorporated by reference in the description of the present invention.

A handbook, entitled "Shock and Vibration Handbook", edited by Cyril M. Harris and Charles E. Crede, discusses the application of resilient supports on pages 3-24 through 3-29 in Volume 1 which is titled "Basic Theory and Measurements." On these pages, the editors provide examples, equations, and discussions about various support systems in which resilient mounts are used to support a body that is subjected to vibration. Although this book does not specifically address the support mounts for an outboard motor, some of its principles are applicable to the present invention and its discussion helps to understand some of the terminology.

Certain types of outboard motors, particularly those having four stroke engines, require that portions of the exhaust system and the oil sump be located at regions within the structure of the outboard motor that can interfere with the conventional placement of support mounts. Since the positioning of support mounts for an outboard motor sometimes interfere with either the oil sump or portions of the exhaust system, it would be significantly beneficial if a support system could be provided which locates the mounts away from and in non-interfering relation with the oil sump, exhaust system, and other portions of the outboard motor.

SUMMARY OF THE INVENTION

A marine propulsion support system made in accordance with a preferred embodiment of the present invention comprises first and second mounts, an outboard motor comprising an engine and being supported by the first and second mounts, and a bracket configured to support the first and second mounts for rotation about a generally vertical steering system. The first and second mounts are disposed on a circumference of a circle. The first mount has a first radial axis of stiffness directed inwardly with respect to the circle and a first tangential axis of stiffness which is generally perpendicular to the first radial axis of stiffness. The first radial and tangential axes of stiffness intersect at a first effective center of response. The second mount is similarly constructed. A center of gravity of the outboard motor is located aft of, or behind, a line connecting the first and second effective centers of response. The first and second mounts define an elastic center point which is behind the line connecting the first and second effective centers of response.

In certain embodiments of the present invention, a first magnitude of stiffness in a direction parallel to the first radial axis of stiffness is at least five times as great as a first magnitude of stiffness in a direction parallel to the first tangential axis of stiffness. The second mount similarly has second magnitudes of stiffness in directions parallel to the second radial and tangential axes of stiffness of a similar ratio. In a particularly preferred embodiment of the present invention, this ratio, for both mounts, of the radial stiffness to the tangential stiffness is at least seven.

In a preferred embodiment of the present invention, the first and second mounts are tubular mounts which have first and second central axes. The first and second central axes intersect at an included angle having a magnitude between 60 degrees and 180 degrees. In a particularly preferred embodiment of the present invention, this included angle is between 80 and 100 degrees.

In a particularly preferred embodiment of the present invention, the first and second central axes are generally perpendicular to the first and second radial axes, respectively. The elastic center point is generally coincident with the center of gravity of the outboard motor in a preferred embodiment of the present invention.

In a particularly preferred embodiment of the present invention, the support system comprises a first tubular mount having a first central axis and a first perpendicular axis intersecting the first central axis at a first central point and a second tubular mount having a second central axis and a second perpendicular axis intersecting the second central axis at a second central point. The first and second central points are disposed in a first vertical plane. The first and second perpendicular axes intersect at an intersection point which is disposed in a second vertical plane. The second vertical plane is generally parallel to the first vertical plane. The center of gravity of the outboard motor in a preferred embodiment of the present invention is between the first and second vertical planes. The first and second mounts define the elastic center point which is behind the first vertical plane. The elastic center point, in a particularly preferred embodiment of the present invention, is generally coincident with the center of gravity of the outboard motor, the first effective center of response is generally coincident with first center point, and the second effective center of response is generally coincident with the second center point.

It should be understood that, throughout the description of the preferred embodiment, the repeated references to the "center of gravity" are intended to identify the position of a generally vertical roll axis that usually intersects the center of gravity of the outboard motor. In addition, it should be understood that the center of gravity in many outboard motor applications is not precisely within the generally horizontal plane defined by the first and second center points of the mounts and the elastic center point defined by the first and second mounts.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
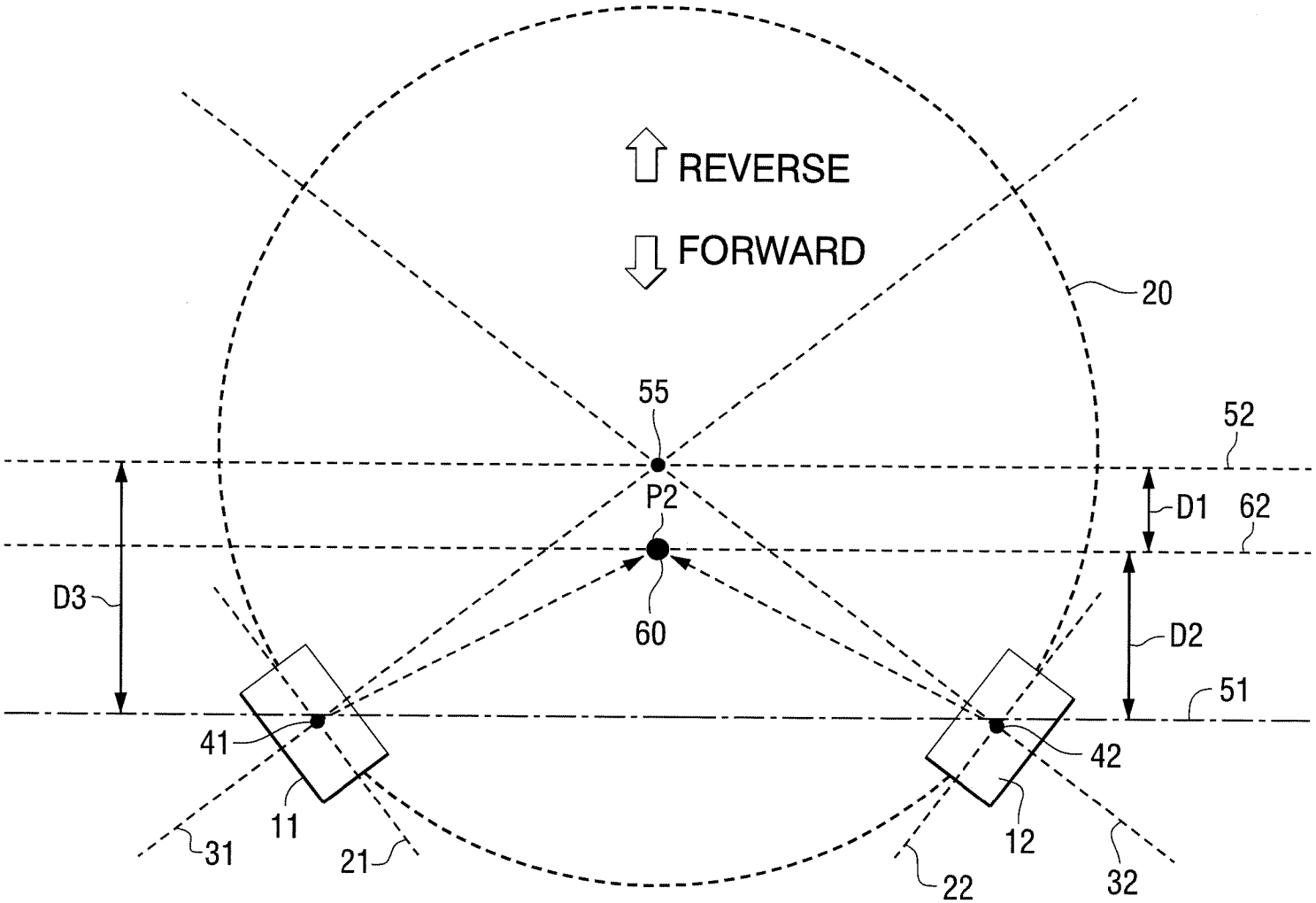
FIG. 1 is a schematic representation of numerous imaginary lines that are used to describe the relative positions of the mounts in a preferred embodiment of the present invention in conjunction with a roll axis.

Throughout the description of the preferred embodiment of the present invention, like components will be identified by like reference numerals.

Figure 2:
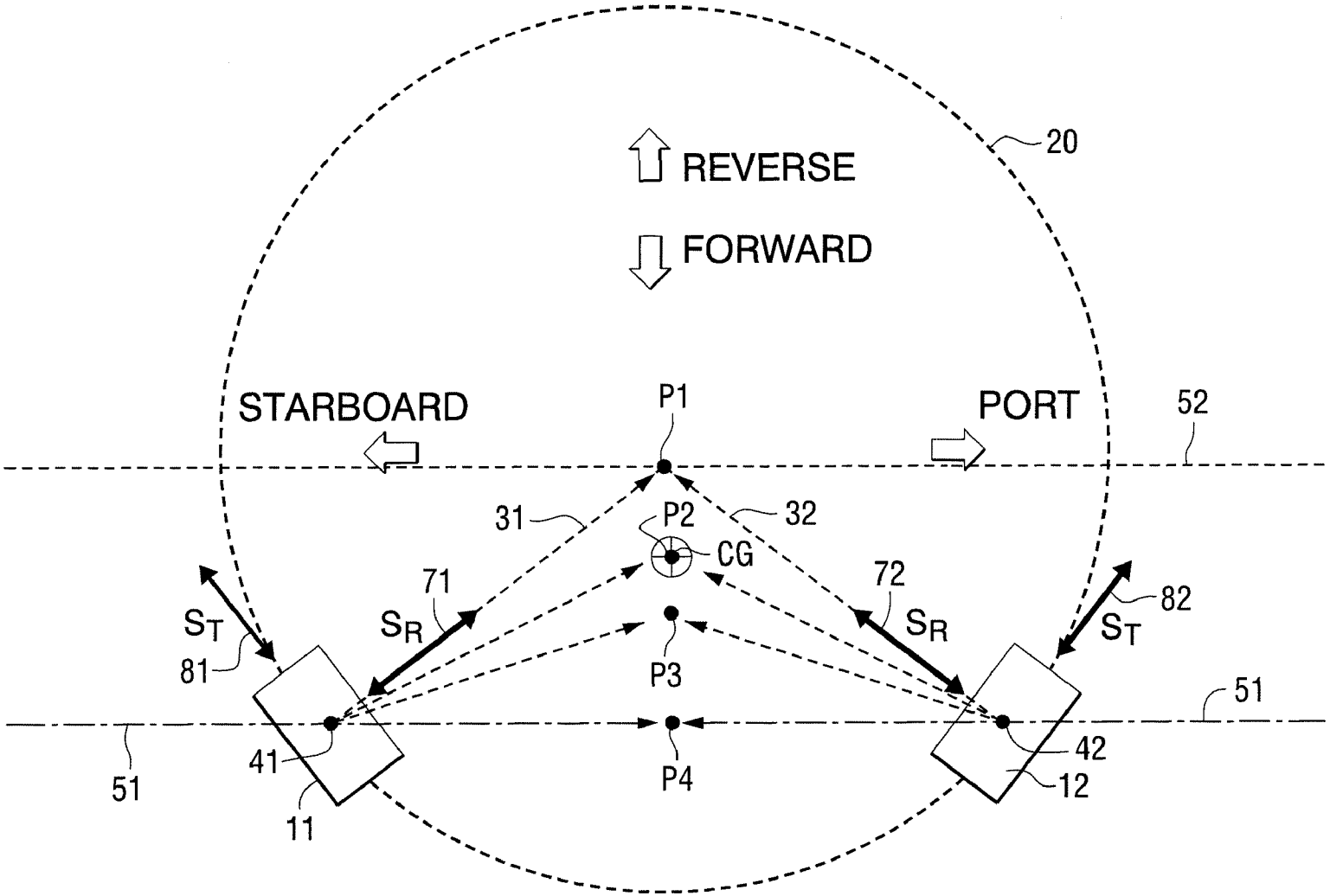
FIG. 2 is generally similar to FIG. 1, but also shows various optional intersect points resulting from different magnitudes of tangential and radial stiffness of the mounts.
Figure 3:
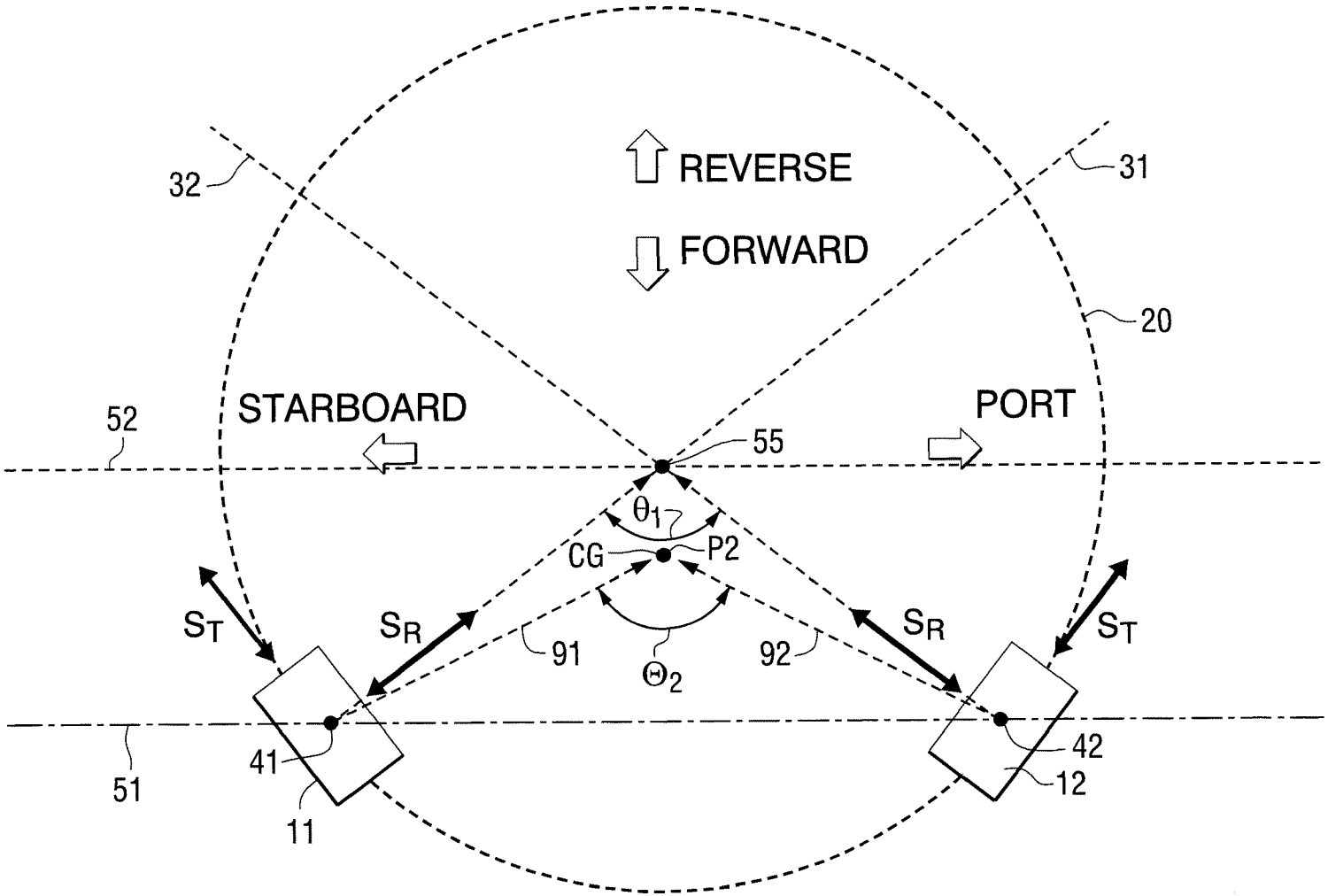
FIG. 3 is generally similar to FIGS. 1 and 2 but show a selected intersection point in relation to various other physical positions.
Figure 4:
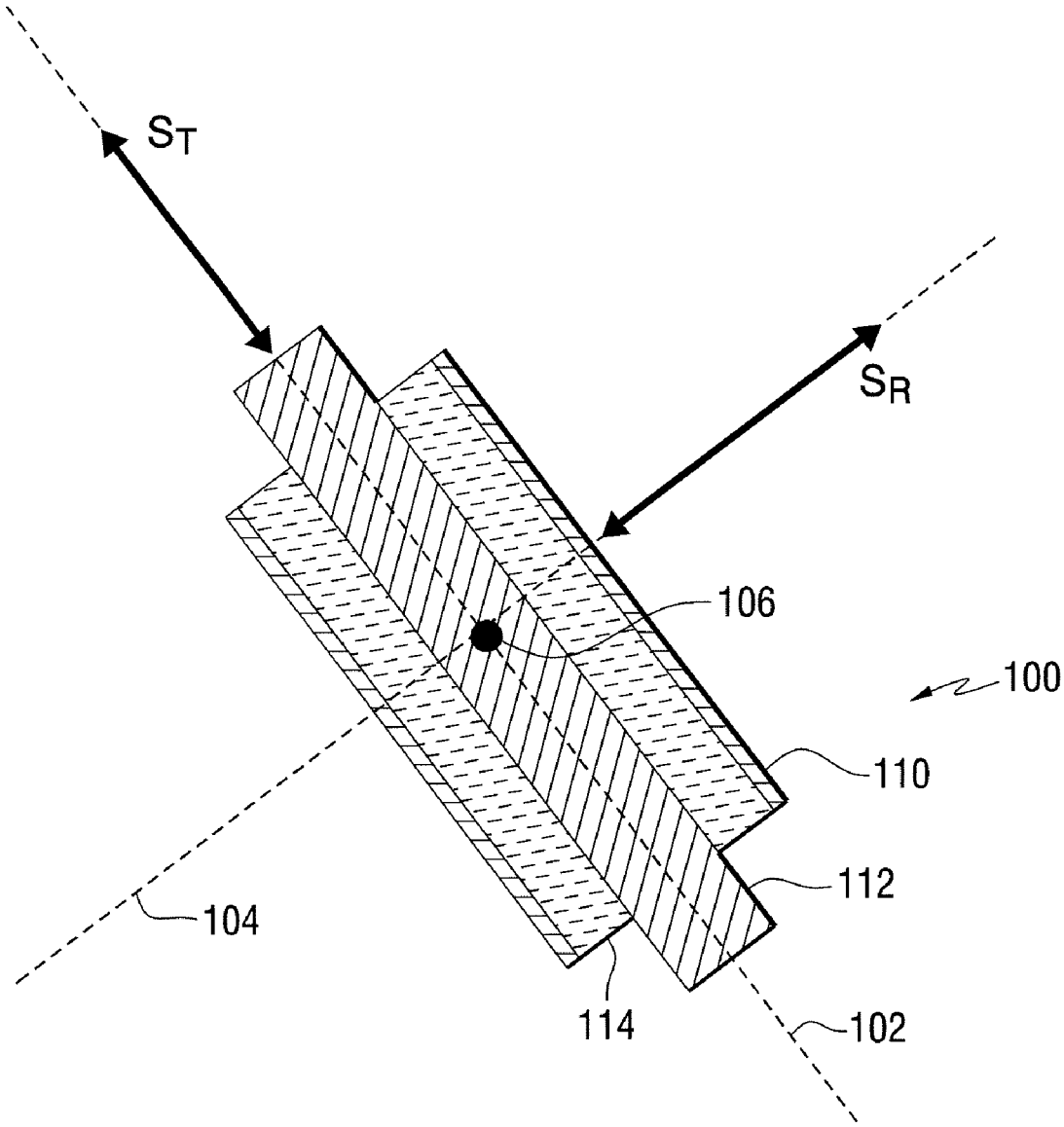
FIG. 4 is a highly schematic sectional view of a tubular mount.

FIGS. 1-4 are highly schematic and conceptual representations of various components and configurations that relate to the concepts of a preferred embodiment of the present invention. FIG. 1 comprises numerous imaginary geometric construction lines that are used to define certain terminology and relative positions between components and other characteristics, such as the center of gravity of the outboard motor and a roll axis extending through it. FIG. 2 is generally similar to FIG. 1, but with vectors that are intended to show the effect of various magnitudes of stiffness of the mounts used to support an outboard motor. FIG. 3 is also generally similar to FIGS. 1 and 2, but is intended to show a particular elastic center location in a preferred embodiment of the present invention. FIG. 4 is a section view of a specific tubular mount structure that is intended to help to show the meaning of certain terminology used throughout the description of the preferred embodiment.

FIG. 1 is a simplified schematic representation of a first mount 11 and a second mount 12 that are used to support an outboard motor. For purposes of describing the physical location of the two mounts, 11 and 12, an imaginary circle 20 is used. The first mount 11 has a first central axis 21 and a first perpendicular axis 31 intersecting the first central axis 21 at a first central point 41. In this description of a preferred embodiment of the present invention, the mounts, 11 and 12, will be described as generally tubular mounts similar to the one shown in section view in FIG. 4. However, it should be clearly understood that the concepts of the present invention do not depend on the use of tubular mounts in all of its embodiments. Different types of mounts can be configured and located according to the concepts of the present invention and the advantages of the present invention can be achieved when tubular mounts are not used. A second tubular mount 12 has a second central axis 22 and a second perpendicular axis 32 intersecting at a second central point 42. The first and second central points, 41 and 42, are disposed in a first vertical plane 51. The first and second perpendicular axes, 31 and 32, intersect at an intersection point 55 which is disposed in a second vertical plane 52. The second vertical plane 52 is generally parallel to the first vertical plane 51.

With continued reference to FIG. 1, a center of gravity 60 of the outboard motor is identified as a point. It should be understood that the basic concepts of the present invention are more directly related to a roll axis that extends, in a generally vertical direction, through the center of gravity 60. The roll axis is an axis about which the outboard motor tends to rotate in response to vibrations caused by the operation of its engine. In a preferred embodiment of the present invention, the support mounts, 11 and 12, are intended to support an outboard motor that is provided with one or more balance shafts that are responsive to vibrations in the forward and reverse directions that are identified by arrows in FIG. 1. Because of the use of balance shafts, the present invention is primarily concerned with rotational vibration effects which will be exhibited as vibrations about the roll axis which generally intersects the center of gravity 60 and which is generally vertical in position. Reference numeral 62 identifies a line extending through the center of gravity 60 and its associated roll axis. It should be understood that the center of gravity 60 in a typical outboard motor application is not always located within the plane defined by points 41, 42 and 55. It can be above or below that generally horizontal plane, but the associated generally vertical roll axis intersecting the center of gravity 60 will be disposed between the two vertical planes, 51 and 52.

With reference to FIGS. 1 and 2, FIG. 2 shows vectors which represent first radial 71 and tangential 81 stiffnesses of the first mount 11 and second radial 72 and tangential 82 stiffnesses for the second mount 12. These stiffness characteristics are identified as vectors which intersect at their respective center points, 41 and 42, for the two mounts. It should be understood that, when tubular mounts are not used in alternative embodiments of the present invention, the center points of the mounts will be effective center points and not precisely defined in the manner that the center points, 41 and 42, are defined above in conjunction with FIG. 1.

With continued reference to FIGS. 1 and 2, FIG. 2 also shows a plurality of exemplary points, P1-P4, which illustrate the hypothetical intersection points of the elastic responses provided by the two mounts. These four points are potential elastic centers of the mount system, depending on the relative magnitudes of the radial and tangential stiffness magnitudes of the two mounts. Described in simple terms, the ratio between the radial and tangential stiffnesses for each of the two mounts, 11 and 12, will determine their effective stiffness vector and, in turn, will determine where those two effective stiffness vectors intersect. As an example, if each of the mounts has a stiffness ratio, equivalent to the radial stiffness divided by the tangential stiffness, of unity, the two mounts will have effective stiffness vectors that intersect at point P4. As this ratio of the radial stiffness to the tangential stiffness for the two mounts increases, the intersection point will define an elastic center that moves upwardly in FIG. 2. For example, if the ratio of stiffnesses of the two mounts increases above unity, the effective elastic center will move up to point P3. As this ratio increases, the elastic center will move to point P2, P1, and eventually above circle 20 as that ratio gets greater and greater. The ratio of radial to tangential stiffness is determined by the individual characteristics of the mounts. Selection of an elastomeric material and the design of the metallic portions of the mount, along with the size and shape of the elastic material and any additional metallic components within the mount, will change the effective ratio of radial to tangential stiffness. As a result, it should be understood that the precise location of the elastic center of the support system can be selected, within certain physical limitations, to coincide with any of the four points, P1-P4, or any other point. For purposes of reference, arrows have been provided in FIG. 2 to illustrate the forward, reverse, port, and starboard directions.

With reference to FIGS. 1-3, an angle $\theta_1$ is used to identify the included angle defined by the two perpendicular axes, 31 and 32, of the two mounts, 11 and 12. In certain embodiments of the present invention, this angle $\theta_1$ is generally equal to 90 degrees. However, alternative embodiments of the present invention are not limited to this magnitude of 90 degrees. Alternative embodiments of the present invention can use positions of the first and second mounts that define the angle $\theta_1$ in a range of approximately 60 degrees to 180 degrees. However, a preferred embodiment of the present invention provides an angle $\theta_1$ that is between 80 degrees and 100 degrees and, in a particularly preferred embodiment, is generally equal to 90 degrees.

With continued reference to FIGS. 1-3, dashed line arrows, 91 and 92, represent the directions of the two effective elastic responses of the mounts. They are shown intersecting at point P2 which, in the description above, is coincident with a generally vertical roll axis that extends through the center of gravity. The effective lines, 91 and 92, result from the selection of a particular ratio between the radial and tangential magnitudes of stiffness selected for the two mounts, 11 and 12. In a particularly preferred embodiment of the present invention, this ratio is approximately seven. In most preferred embodiments of the present invention, this ratio is greater than five. The ratio of seven was selected based on two primary criteria. First, the ratio was selected to result in an elastic center that coincided with the roll axis extending vertically through the center of gravity. In addition, since significantly increased ratios could require special mount designs that could significantly increase costs, the positions of the mounts, 11 and 12, were selected so that a commercially available mount could be used without significant and costly redesign being required. Alternative positioning of the mounts could result in the need for different ratios of the radial and tangential stiffnesses. It should be understood that the desired ratio and the physical positions of the mounts are interrelated and provide design flexibility in the effort to achieve an elastic center that generally coincides with the vertical roll axis intersecting the center of gravity.

FIG. 4 is a section view of a tubular mount 100 that can be used as either or both mounts, 11 and 12, described above in conjunction with FIGS. 1-3. Although designs of mounts used in outboard motor applications vary significantly in size, shape, and component selection, the mount 100 shown in FIG. 4 is intended to be exemplary. It comprises an outer cylindrical tube 110 and a central rod 112. Between these two metallic components, an elastomeric material 114 provides the only contact between the tube 110 and the rod 112. The particular material selected as the elastomeric material 114 will determine, to some degree, the stiffness of the mount in both its radial and tangential directions, $S_R$ and $S_T$. As a result, it will also determine, to some extent, the ratio between these stiffnesses. However, it should be understood that the selected material used as the elastomeric material 114 in the mount is not the sole determination of either the stiffness magnitudes or the ratio. In addition, the relative thickness and length of the elastomeric material 114 in relation to the size and shape of the tube 110 and rod 112 will also play a determining factor in these stiffness magnitudes. Dashed line 102 represents a central axis of the mount and dashed line 104 represents a line that is perpendicular to the central axis 102 and intersects that axis at the center point 106. The reference numerals used in FIG. 4 are different than those used in FIGS. 1-3 to identify similar components because the mount shown in section view in FIG. 4 represents either or both of the mounts, 11 and 12, described above in conjunction with FIGS. 1-3. The stiffness vectors, $S_R$ and $S_T$, are shown in alignment with their respective axes, 102 and 104, but it should be understood that the magnitudes of the vectors can differ significantly and will functionally determine the effective direction of stiffness response for the mounts. As a result, the elastic center 60 at the intersection of these effective lines of response need not be at the intersection point 55 between the perpendicular axes, 31 and 32, which are represented by axis 104 in FIG. 4.

With continued reference to FIGS. 1-4, it can be seen that a marine propulsion support system made in accordance with a particularly preferred embodiment of the present invention can comprise a first tubular mount 11 having a first central axis 21 and a first perpendicular axis 31 intersecting at a first central point 41, a second tubular mount 12 having a second central axis 22 and a second perpendicular axis 32 intersecting at a second central point 42, an outboard motor comprising an engine and being supported by the first and second mounts, 11 and 12. The first and second central points, 41 and 42, are disposed in a vertical plane 51. The first and second perpendicular axes, 31 and 32, intersect at an intersection point 55 which is disposed in a second vertical plane 52. The second vertical plane 52 is generally parallel to the first vertical plane 51. The first mount 11 has a first radial axis of stiffness directed perpendicularly to the first central axis 21 and a first tangential axis of stiffness which is generally perpendicular to the first radial axis of stiffness. The first radial and tangential axes of stiffness intersect at the first central point 41. The second mount 12 has a second radial axis of stiffness directed perpendicularly to the second central axis 22 and a second tangential axis of stiffness which is generally perpendicular to the second radial axis of stiffness. The second radial and tangential axes of stiffness intersect at the second central point 42. A generally vertical roll axis intersects a center of gravity 60 of the outboard motor and is between the first and second vertical planes, 51 and 52. The first and second mounts, 11 and 12, define an elastic center point P2 which is behind the first vertical plane 51. A bracket is configured to support the first and second mounts, 11 and 12, for rotation about a generally vertical steering axis. A first magnitude of stiffness in a direction parallel to the first radial axis of stiffness is at least seven times as great as a first magnitude of stiffness in a direction parallel to the first tangential axis of stiffness in a preferred embodiment of the present invention. Similarly, in the preferred embodiment of the present invention, a second magnitude of stiffness in a direction parallel to the second radial axis of stiffness is at least seven times as great as a second magnitude of stiffness in a direction parallel to the second tangential axis of stiffness. The elastic center point is between the first and second vertical planes, 51 and 52, in a particularly preferred embodiment of the present invention. The first and second perpendicular axes, 31 and 32, intersect at an included angle $\theta_1$ having a magnitude of at least 60 degrees in a preferred embodiment of the present invention and, in a particularly preferred embodiment, the included angle has a magnitude between 80 degrees and 100 degrees. The elastic center point is generally coincident with the generally vertical roll axis which intersects the center of gravity. The first effective center of response is generally coincident with the first center point 41 and the second effective center of response is generally coincident with the second center point 42.

Figure 5:
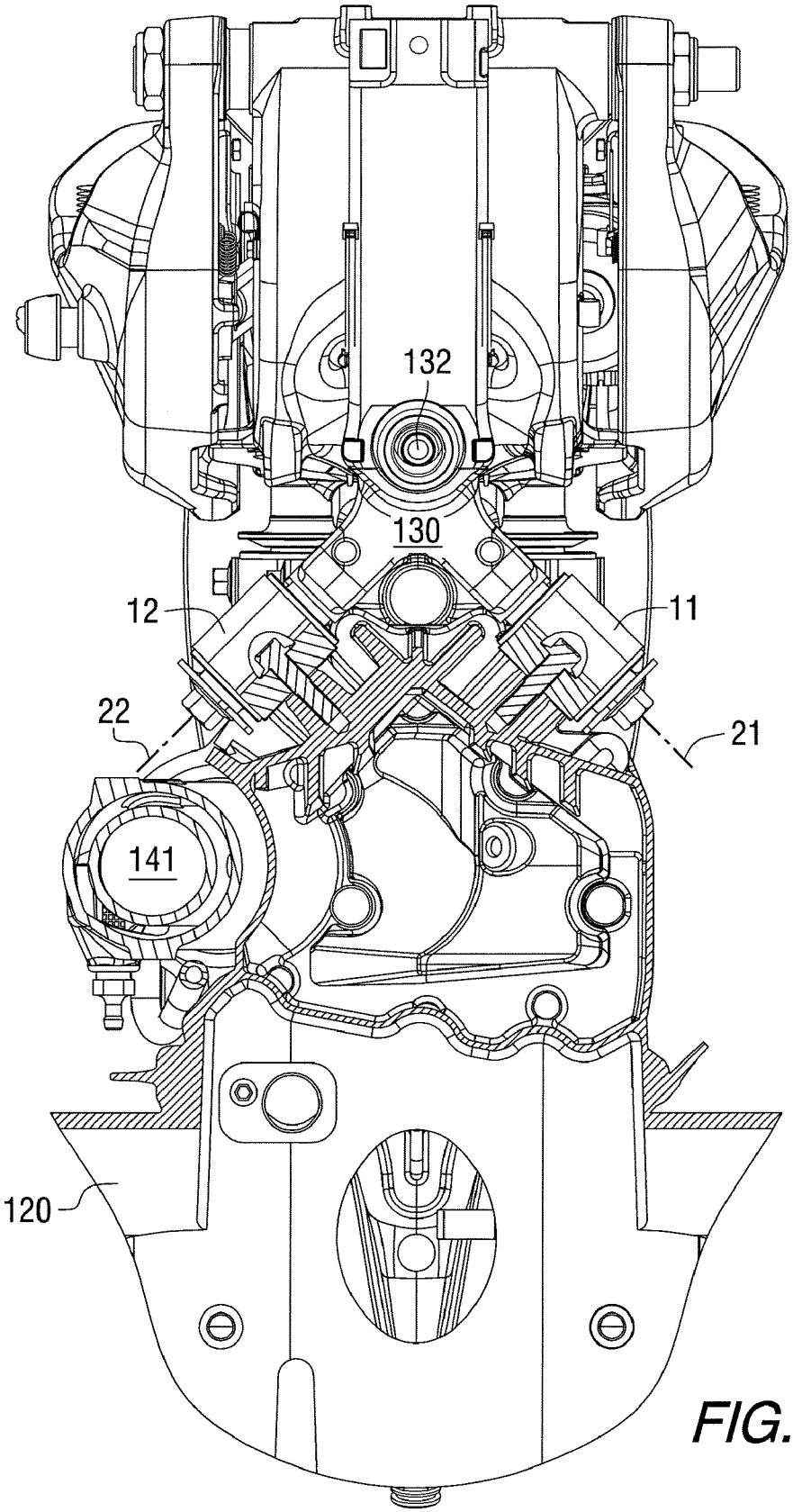
FIG. 5 is a top view of a portion of the outboard motor showing an adapter plate, a steering bracket, and two mounts.
Figure 6:
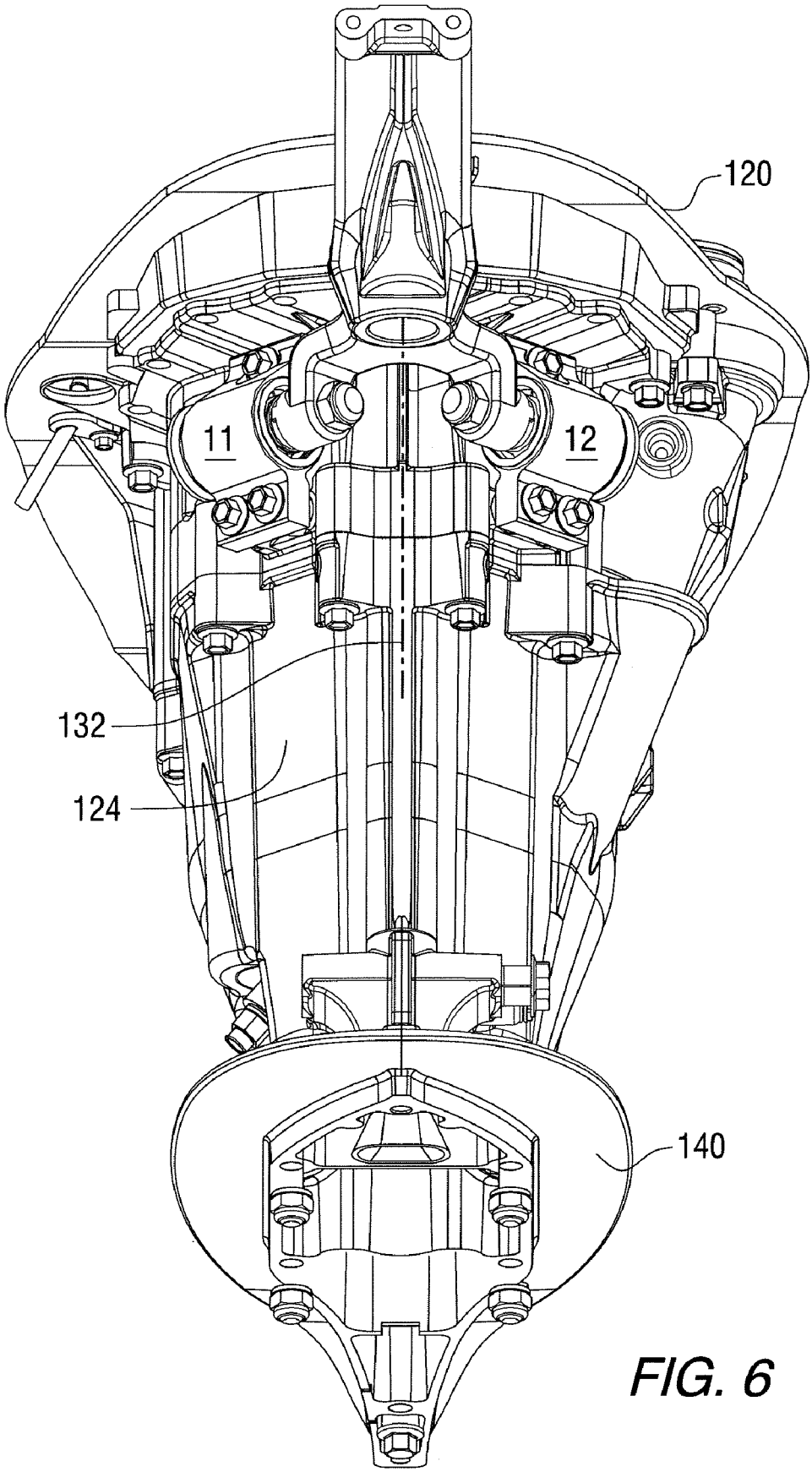
FIG. 6 is an isometric view from in front of an outboard motor showing to the positions of two mounts in relation to an adapter plate and a driveshaft housing.
Figure 7:
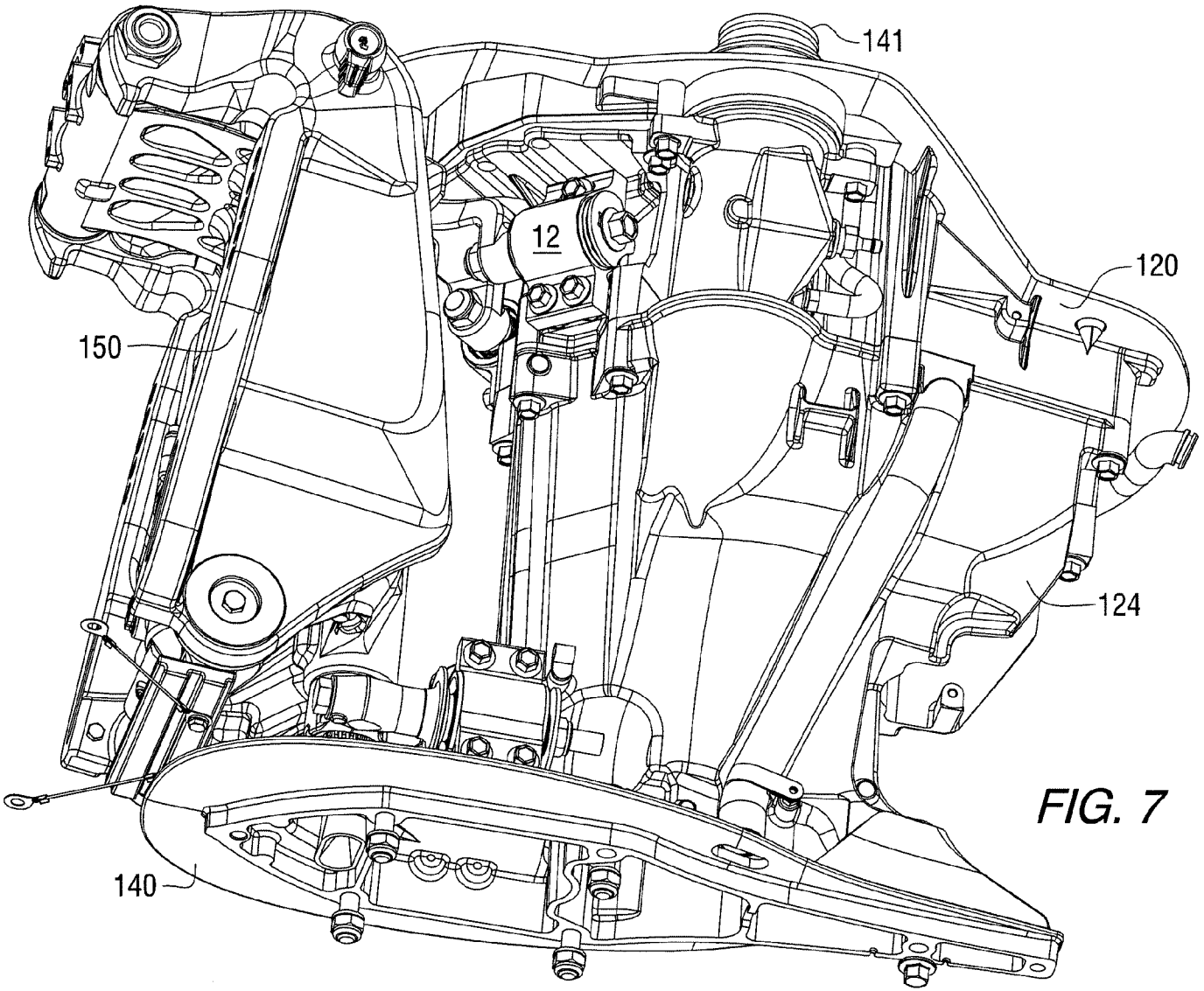
FIG. 7 is an isometric view from the port side of an outboard motor showing the mounts of a preferred embodiment of the present invention in conjunction with a transom bracket and certain other housing components of an outboard motor.

FIGS. 5-7 are views of a portion of an outboard motor. They show the relationship between the mounts, an engine support plate, a driveshaft housing, and a steering bracket which is rotatable about a generally vertical steering axis. FIG. 5 is a partially sectioned view from above the mounts and the adapter plate 120 that supports an engine of the outboard motor. FIG. 6 is a view from in front of the outboard motor looking toward the rear from the direction of a transom of a marine vessel. FIG. 7 is a side view from the port side of an outboard motor. In order to more clearly show the relationship between the mounts of the present invention and an outboard motor, the driveshaft housing and adapter plate 120 are shown in FIGS. 5-7 without the gear case, propeller, engine, and cowl which would normally be attached to the driveshaft housing 124 and adapter plate 120.

In FIG. 5, the mounts, 11 and 12, are shown supported by a bracket 130 for rotation about a steering axis 132. An exhaust conduit 141 is shown in it position that it would occupy in one particular design of an outboard motor. It can be seen that the location of the mounts, 11 and 12, are not interfering with the location of the exhaust passage 141. However, if the mounts were placed in a conventional location in a more aft position and aligned with their central axes, 21 and 22, parallel to each other, interference with the exhaust conduit 141 would be more likely. Also, it should be noted that the position of the mounts, 11 and 12, illustrated in FIG. 5 avoid interference with the location of an oil sump.

FIG. 6 is a view of an outboard motor from in front of the driveshaft housing 124. It illustrates the positions of the two mounts, 11 and 12, relative to the generally vertically steering axis 132. It also shows the position of the adapter plate 120 relative to the driveshaft housing 124. Those skilled in the art of marine propulsion devices are aware that a gear case would be attached below the anticavitation plate 140. The gear case housing is not illustrated in FIG. 6.

FIG. 7 shows the driveshaft housing 124 and adapter plate 120 in conjunction with a transom bracket 150 that facilitates the attachment of an outboard motor to a transom of a marine vessel.

With continued reference to FIGS. 4 and 5-7, it can be seen that nuts, which are shown in FIGS. 5-7, are used at the distal ends of the rod 112 for each of the mounts, 11 and 12, to facilitate the attachment of the mounts to the steering bracket 130. In addition, with particular attention to FIGS. 4 and 5, it can be seen that bolts attach the cylindrical tube 110 of the mounts to the adapter plate 120. This can be seen in FIGS. 5-7. Since the present invention is particularly intended for use in conjunction with an outboard motor that has a pair of balance shafts used in conjunction with a four stroke engine, its primary function is to respond to vibrations that would tend to cause the outboard motor to rotate about a roll axis that is usually generally vertical and typically intersects the center of gravity of the outboard motor. Since four stroke engines incorporate an oil sump, it is beneficial if the mounts are configured to avoid interference with the position of the oil sump. It is also beneficial if the mounts are located at a place that does not interfere or pass in close proximity to exhaust components. Both of these characteristics help to avoid raising the temperature of the mounts to magnitudes that might otherwise damage the elastomeric portions of the mounts. The present invention addresses these concerns by positioning the central axes of the rod of the mounts at an angle that allows the mounts to be located forward from the adapter plate 120 that supports the engine and in a non-interfering relationship with the internal components of the engine structure and its supporting components. By advantageously using mounts that have ratios, of their radial stiffnesses to their tangential stiffnesses, in excess of approximately 5-7 and positioning the mounts at an appropriate angle to suit that ratio, the elastic center of the support system can be positioned at or near the roll axis. Since the vibrations that are along straight lines either forward-aft or port-starboard are addressed by the use of balance shafts, the primary purpose of the mount structure of the present invention is to react to rotational motions about the roll axis caused by tortional vibration.

The shape and structure of the elastomeric material, in combination with the configuration of the metallic portions of the mounts, results in the elastic center point being generally coincident with the generally vertical roll axis which typically intersects the center of gravity of the outboard motor. It should be clearly understood that the center of gravity of the outboard motor is not necessarily located within the generally horizontal plane defined by points 55, 41, and 42. However, the roll axis intersects that plane.

Although the present invention has been described in particular detail and illustrated to show a preferred embodiment, it should be understood that alternative embodiments are also within its scope.

We claim:

1. A marine propulsion support system, comprising:

a first mount;

a second mount;

an outboard motor comprising an engine support structure and being supported by said first and second mounts, said first and second mounts being disposed on a circumference of a circle, said first mount having a first radial axis of stiffness directed inwardly with respect to said circle and a first tangential axis of stiffness which is generally perpendicular to said first radial axis of stiffness, said first radial and tangential axes of stiffness intersecting at a first effective center of response, said second mount having a second radial axis of stiffness directed inwardly with respect to said circle and a second tangential axis of stiffness which is generally perpendicular to said second radial axis of stiffness, said second radial and tangential axes of stiffness intersecting at a second effective center of response, a generally vertical roll axis intersecting a center of gravity of said outboard motor being aft of a line connecting said first and second effective centers of response, said first and second mounts defining an elastic center point which is behind said line connecting said first and second effective centers of response; and a bracket configured to support said first and second mounts for rotation about a generally vertical steering axis.

2. The system of claim 1, wherein:

a first magnitude of stiffness in a direction parallel to said first radial axis of stiffness is at least five times as great as a first magnitude of stiffness in a direction parallel to said first tangential axis of stiffness; and a second magnitude of stiffness in a direction parallel to said second radial axis of stiffness is at least five times as great as a second magnitude of stiffness in a direction parallel to said second tangential axis of stiffness.

3. The system of claim 2, wherein:

a first magnitude of stiffness in a direction parallel to said first radial axis of stiffness is at least seven times as great as a first magnitude of stiffness in a direction parallel to said first tangential axis of stiffness; and a second magnitude of stiffness in a direction parallel to said second radial axis of stiffness is at least seven times as great as a second magnitude of stiffness in a direction parallel to said second tangential axis of stiffness.

4. The system of claim 1, wherein:

said first mount is a tubular mount having a first central axis and a first perpendicular axis intersecting said first central axis at a first central point; and said second mount is a tubular mount having a second central axis and a second perpendicular axis intersecting said second central axis at a second central point, said first and second central points being disposed in a first vertical plane, said first and second perpendicular axes intersecting at an intersection point which is disposed in a second vertical plane, said second vertical plane being generally parallel to said first vertical plane, said elastic center point being between said first and second vertical planes.

5. The system of claim 4, wherein:

said first and second perpendicular axes intersect at an included angle having a magnitude of at least sixty degrees and less than one hundred and twenty degrees.

6. The system of claim 4, wherein:

said first and second perpendicular axes intersect at an included angle having a magnitude of at least eighty degrees and less than one hundred degrees.

7. The system of claim 4 wherein:

said first central axis is generally perpendicular to said first radial axis of stiffness; and said second central axis is generally perpendicular to said second radial axis of stiffness.

8. The system of claim 4, wherein:

said first effective center of response is generally coincident with said first center point; and said second effective center of response is generally coincident with said second center point.

9. The system of claim 1, wherein:

said elastic center point is generally coincident with said generally vertical roll axis intersecting said center of gravity.

10. A marine propulsion support system, comprising:

a first tubular mount having a first central axis and a first perpendicular axis intersecting said first central axis at a first central point;

a second tubular mount having a second central axis and a second perpendicular axis intersecting said second central axis at a second central point, said first and second central points being disposed in a first vertical plane, said first and second perpendicular axes intersecting at an intersection point which is disposed in a second vertical plane, said second vertical plane being generally parallel to said first vertical plane;

an outboard motor comprising an engine support structure and being supported by said first and second mounts, said first mount having a first radial axis of stiffness directed perpendicularly to said first central axis and a first tangential axis of stiffness which is generally perpendicular to said first radial axis of stiffness, said first radial and tangential axes of stiffness intersecting at said first central point, said second mount having a second radial axis of stiffness directed perpendicularly to said second central axis and a second tangential axis of stiffness which is generally perpendicular to said second radial axis of stiffness, said second radial and tangential axes of stiffness intersecting at said second central point, a generally vertical roll axis intersecting a center of gravity of said outboard motor being between said first and second vertical planes, said first and second mounts defining an elastic center point which is behind said first vertical plane; and a bracket configured to support said first and second mounts for rotation about a generally vertical steering axis.

11. The system of claim 10, wherein:

a first magnitude of stiffness in a direction parallel to said first radial axis of stiffness is at least seven times as great as a first magnitude of stiffness in a direction parallel to said first tangential axis of stiffness; and a second magnitude of stiffness in a direction parallel to said second radial axis of stiffness is at least seven times as great as a second magnitude of stiffness in a direction parallel to said second tangential axis of stiffness.

12. The system of claim 11, wherein:

said elastic center point is between said first and second vertical planes.

13. The system of claim 12, wherein:

said first and second perpendicular axes intersect at an included angle having a magnitude of at least sixty degrees.

14. The system of claim 13, wherein:

said first and second perpendicular axes intersect at an included angle having a magnitude of at least eighty degrees and less than one hundred degrees.

15. The system of claim 10, wherein:

said elastic center point is generally coincident with said generally vertical roll axis intersecting said center of gravity.

16. The system of claim 10, wherein:

said first effective center of response is generally coincident with said first center point; and said second effective center of response is generally coincident with said second center point.

17. A marine propulsion support system, comprising:

a first tubular mount having a first central axis and a first perpendicular axis intersecting said first central axis at a first central point;

a second tubular mount having a second central axis and a second perpendicular axis intersecting said second central axis at a second central point, said first and second central points being disposed in a first vertical plane, said first and second perpendicular axes intersecting at an intersection point which is disposed in a second vertical plane, said second vertical plane being generally parallel to said first vertical plane;

an outboard motor comprising an engine support structure and being supported by said first and second mounts, said first mount having a first radial axis of stiffness directed perpendicularly to said first central axis and a first tangential axis of stiffness which is generally perpendicular to said first radial axis of stiffness, said first radial and tangential axes of stiffness intersecting at said first central point, said second mount having a second radial axis of stiffness directed perpendicularly to said second central axis and a second tangential axis of stiffness which is generally perpendicular to said second radial axis of stiffness, said second radial and tangential axes of stiffness intersecting at said second central point, a generally vertical roll axis intersecting a center of gravity of said outboard motor being between said first and second vertical planes, said first and second mounts defining an elastic center point which is behind said first vertical plane, said elastic center point is generally coincident with said generally vertical roll axis intersecting said center of gravity, said elastic center point is between said first and second vertical planes; and a bracket configured to support said first and second mounts for rotation about a generally vertical steering axis.

18. The system of claim 17, wherein:

a first magnitude of stiffness in a direction parallel to said first radial axis of stiffness is at least seven times as great as a first magnitude of stiffness in a direction parallel to said first tangential axis of stiffness; and a second magnitude of stiffness in a direction parallel to said second radial axis of stiffness is at least seven times as great as a second magnitude of stiffness in a direction parallel to said second tangential axis of stiffness.

19. The system of claim 18, wherein:

said first and second perpendicular axes intersect at an included angle having a magnitude of at least sixty degrees and less than one hundred degrees.

20. The system of claim 19, wherein:

said first effective center of response is generally coincident with said first center point; and said second effective center of response is generally coincident with said second center point.

* * * * *